United States Patent [19]

Letard et al.

[11] Patent Number: 4,598,919

[45] Date of Patent: Jul. 8, 1986

[54] TROLLEY FOR MOVING TEXTILE PIECES BETWEEN WORKSTATIONS

[75] Inventors: Michel Letard; Daniel Renouvin; Joseph Dupont, all of Tinchebray, France

[73] Assignee: Societe Normande de Confection, Tinchebray, France

[21] Appl. No.: 617,479

[22] Filed: Jun. 5, 1984

[30] Foreign Application Priority Data

Jun. 7, 1983 [FR] France ..... 83 09417

[51] Int. Cl.[4] ..... B62B 1/44

[52] U.S. Cl. ..... 280/79.1 R; 248/125

[58] Field of Search ..... 280/79.1 R; 211/89, 211/45, 47.1, 8, 24, 207; 414/97; 112/121.29, 121.12, 121.15; 248/121, 125; 271/175; 269/67, 68, 69, 70, 207–208, 210–212, 214–215; 254/2 B, 2 R

[56] References Cited

U.S. PATENT DOCUMENTS

| | | | |
|---|---|---|---|
| 1,732,081 | 10/1929 | Clement | 269/67 |
| 2,654,147 | 10/1953 | Wilson et al. | 269/70 |
| 3,272,464 | 9/1966 | Jacobson | 248/125 |
| 3,666,260 | 5/1972 | Myers | 269/214 |
| 3,702,139 | 11/1972 | Chaffin | 254/2 R |
| 3,883,933 | 5/1975 | Kightlinger et al. | 24/250 R |

FOREIGN PATENT DOCUMENTS

| | | | |
|---|---|---|---|
| 1448956 | 7/1966 | France | 269/215 |
| 2041300 | 1/1971 | France | 269/210 |
| 1182373 | 7/1967 | U.S.S.R. | 112/121.29 |

*Primary Examiner*—David M. Mitchell
*Assistant Examiner*—Eric D. Culbreth
*Attorney, Agent, or Firm*—Cushman, Darby & Cushman

[57] ABSTRACT

A trolley for moving textile pieces between workstations comprises a clamp with two parallel branches. One branch can be maneuvered by means of a perpendicular arm associated with another ratchet. The other is fixed and coaxial with a disk associated with a ratchet whereby its orientation may be varied. The clamp is mounted on a crossmember of a movable member of a vertical jack. The jack is disposed between two tubular columns which guide the crossmember and one of which has at its upper end a quick-release connector. This is used to connect the jack to a compressed air supply.

7 Claims, 3 Drawing Figures

TROLLEY FOR MOVING TEXTILE PIECES BETWEEN WORKSTATIONS

BACKGROUND OF THE INVENTION

1. Field of the Invention

The object of the invention is an improved trolley specially designed for moving textile pieces used in the manufacture of clothing between successive workstations.

2. Description of the Prior Art

As is known, in the mass production of clothing pieces are cut out from stacks comprising numerous layers of cloth and these pieces are then assembled in batches which are moved from each workstation to the next. The most primitive method of procuring such discontinuous movement consists in the use of baskets which are carried; subsequently, ordinary trolleys were used. Continuing development lead to endless loops permitting continuous circulation of pieces suspended from clamps, with offshoots at each workstation. An automated installation of this kind is costly, it is not economically justifiable in manufacturing workshops of relatively small size and with a relatively limited production capacity.

The principal object of the invention is thus to provide a trolley which allows for the discontinuous movement of clothing pieces but improved in such a way that it offers the greatest convenience in use and reduces the movement required of the user, consequently offering the greatest possible time saving in regard to handling operations between workstations.

SUMMARY OF THE INVENTION

The invention consists in a trolley comprising a platform, some wheels on which said platform is mounted, a vertical jack comprising a member movable vertically upwards and downwards, a clamp mounted at a free end of said member and comprising two contra-acting branches, and maneuvering means linking said branches and adapted to move them towards and away from one another.

This clamp preferably comprises a first branch attached to the movable member, and a second branch movable parallel to the first branch and provided at one end with an arm at 90° to it which passes through the movable member which is then provided with locking means cooperating with this arm to immobilize it at various successive positions. This locking means advantageously comprises a ratchet mechanism including successive depressions formed on the arm and a ratchet mounted on the movable member.

In accordance with one feature of the invention, the movable member comprises guide means for the arm within which the latter may slide longitudinally; it is this guide means which supports the fixed first branch; it is pivotally mounted on a shaft which is preferably disposed horizontally, and it is associated with means for locking it in any rotational position.

In a preferred embodiment of the invention, the guide means may occupy a number of rotational positions as defined by a ratchet mechanism and which correspond to equivalent orientations of the clamp.

The jack is preferably a pneumatic jack disposed between two vertical tubular columns. The movable member is equipped with two sliders each of which slides on one of the tubular columns. At its free upper end distant from the platform one of the columns is fitted with a quick-release connector for connection to a compressed air supply; at its lower end this column is connected to the cylinder of the jack through a supply and vent distributor with associated control unit. This control unit is preferably connected to a control knob disposed at the upper end of the other tubular column.

The end of the arm extending beyond the guide means is advantageously terminated with a handle.

Other objects and advantages will appear from the following description of an example of the invention when considered in connection with the accompanying drawings, and the novel features will be particularly pointed out in the appended claims.

DESCRIPTION OF THE PREFERRED EMBODIMENT

Figure 1:
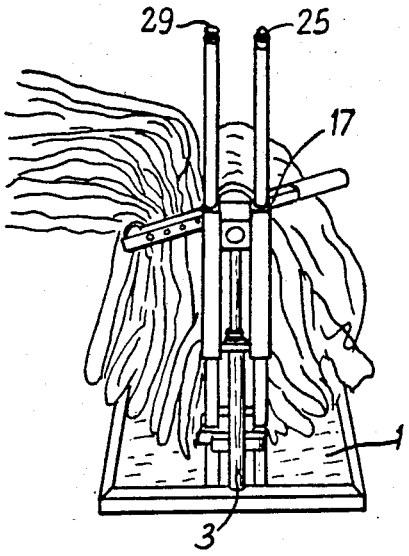
FIG. 1 is a general view in perspective of a trolley in accordance with the invention as seen from above.

A trolley in accordance with the invention comprises a platform 1 mounted on four castors 2 and supporting on one edge a vertical jack 3 which is preferably a pneumatic jack. This comprises a member 4 which is movable vertically upwards and downwards and at the free end of which is mounted a clamp 5. This has two contra-acting branches 6A, 6B extending parallel to one another above the platform 1. The two branches 6A, 6B may be moved closer together and farther apart by maneuvering means, described below, so as to be able to hold clamped between them a batch of pieces of cloth or items of clothing in the process of manufacture, as seen in FIG. 1.

The jack 3 is disposed between two vertical tubular columns 7, 8 on each of which is slidably mounted a repsective slider 7A, 7B. These are coupled by a crossmember 9 which forms part of the vertically movable member 4. The latter is thus appropriately guided.

Inside the crossmember 9 (FIG. 3) there is mounted a shaft 10 which is parallel to the platform 1 and freely rotatable, and of which an end 10A on the same side as the clamp 5 carries a cylindrical disk 11 in the outside perimeter of which are formed eight notches 12 which are circumferentially spaced in radial planes. At the top of the crossmember 9 there is provided a longitudinal slot 13 in which there is mounted, so as to pivot around a shaft 14 transverse to this slot 13, a ratchet 15. This has a first end 15A shaped and dimensioned so as to be able to engage in the notches 12 in the disk 11. The opposite, second end 15B of the ratchet 15 projects out of the crossmember 9 and may be readily grasped. A spring (not shown) holds the ratchet 15 engaged in any of the notches 12. By lowering the end 15B of this ratchet 15 its end 15A is moved out of the notch 12 in which it is engaged and the disk 11 may be moved to a different orientation.

The disk 11 also constitutes guide means for the sliding movement of an arm 17, by virtue of a diametral opening 16 formed in its thickness and the profile and dimensions of which correspond to those of the arm 17. This is fitted at one end with the branch 6A of the clamp 5, which is perpendicular to it, and at its opposite end with a handle 18 which makes it easier to hold in order to slide it through the disk 11.

On its free side 11A disk 11 is fitted with the branch 6B of clamp 5; this branch 6B extends perpendicular to the disk 11, coaxial with the shaft 10. It is fixed, unlike the contra-acting branch 6A which may be moved parallel to itself by means of the arm 17. Means for locking the arm 17 in position are preferably constituted as follows. In the side surface of the arm 17 situated on the same side as the shaft 10 and the crossmember 9 there are provided successive depressions 19 which are regularly spaced along the length of the arm 17. In the disk 11 is a recess 20 which communicates with the diametral opening 16 on the path of movement of the depressions 9 when the arm 17 slides. In the recess 20 is disposed a small ratchet 21 carried by a shaft 22 which passes through the recess 20 and the disk 11 by means of a hole 23 formed through the latter at right angles to its geometrical axis. The shaft 22 is accessible at one end of the hole 23 and is rotatable against a return spring (not shown). The small ratchet 21 is pushed back when acted on by this spring to a first position, visible in FIG. 3, in which its end part is engaged in any of the notches 19. By manually moving the shaft 22 which is accessible externally of the disk the small ratchet 21 may be moved to is second position in which it is totally retracted into the recess 20 so that the arm 17 is free to slide in the diametral opening 16.

Figure 3:
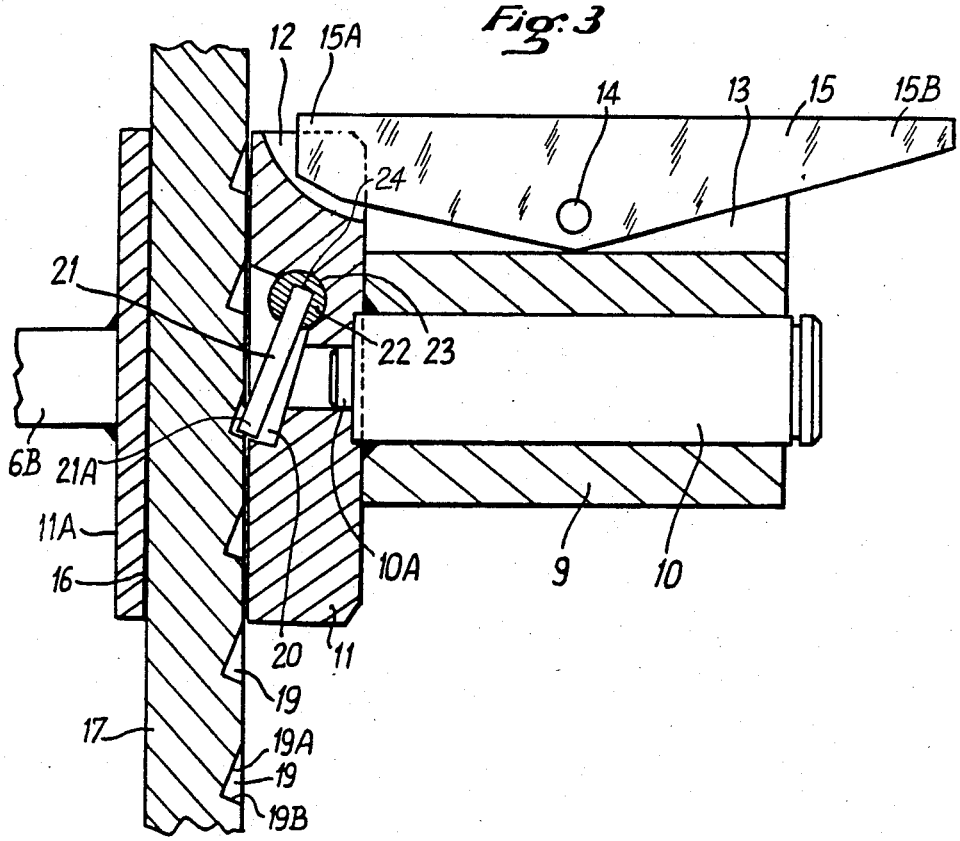
FIG. 3 is an enlarged detailed view showing in axial cross-section the two combined ratchet mechanisms, one for tightening the clamp and the other controlling its orientation.
Figure 2:
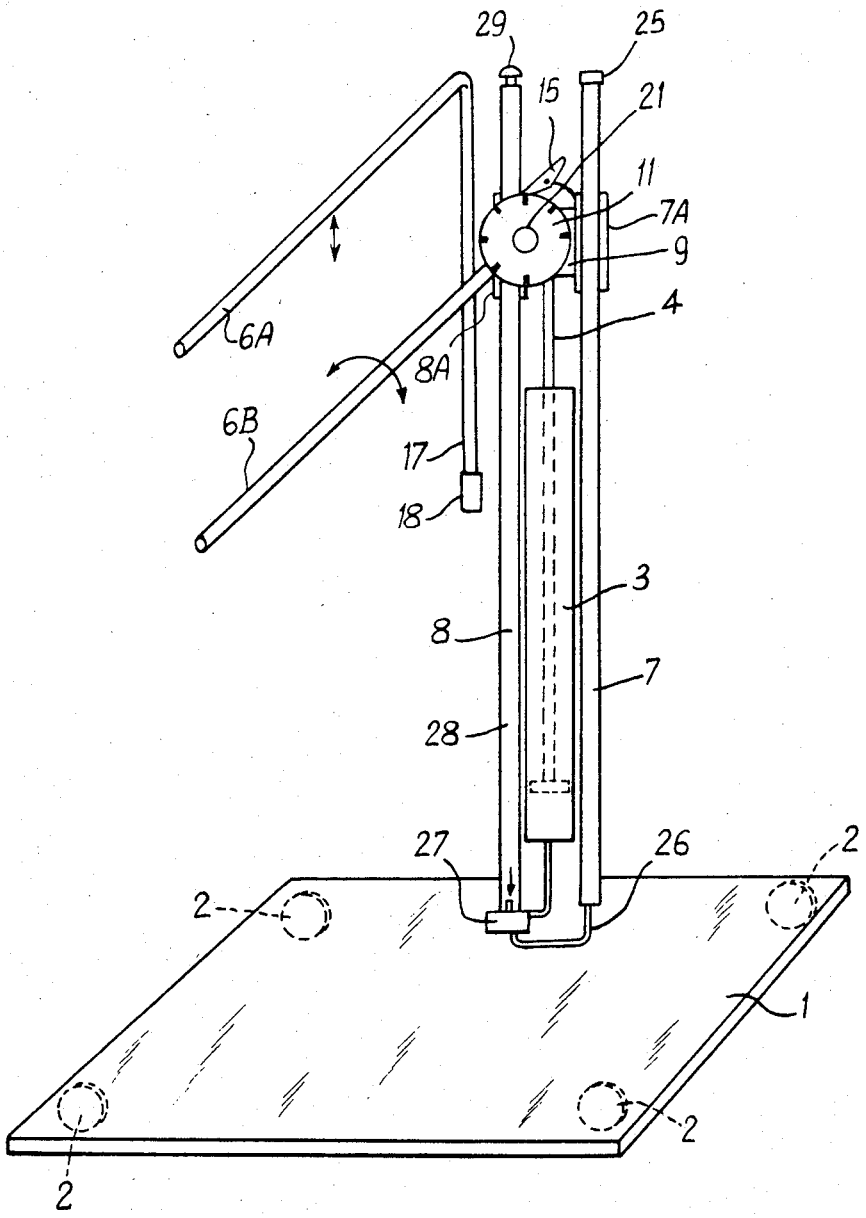
FIG. 2 is a schematic representation of the same trolley referred to in explaining its construction.

The depressions or notches 19 preferably have an inclined side 19A for pushing down the small ratchet 21 when the arm 17 is pulled to move the branch 6A nearer the branch 6B of the clamp 5 in order to grip the clothes in the latter. The depressions 19 have another inclined surface 19B so that the small ratchet 21 abuts against it through its end part 21A when it is not retracted into the recess 20 by rotation of the shaft 22. Thus the compression and the weight of the clothes clamped in the clamp 5 cannot cause it to open, whatever orientation of the clamp 5 results from turning the branch 6B and the shaft 10. In this example, the small ratchet 21 will be located directly opposite the end of shaft 6B as shown in FIG. 3.

The vertical tubular column 7 is provided at its free upper end with a quick-release connector 25 for connection to a compressed air supply line; it is sealed and its lower end is connected by a hose 26 to the lower end of the jack 3, through the intermediary of a distributor 27 having a control unit and an air vent orifice situated at the lower end of the vertical tubular column 8. Within the latter a linkage 28 connects the control unit of the distributor 27 to a knob 29 situated at the top of the tubular column 8.

The trolley in accordance with the invention enables a batch of pieces to be sewn or of items of clothing in the process of manufacture to be quickly clamped in and released from the clamp 5 and the clamp to be easily oriented in the position most suited to the work in hand. When the trolley reaches a workstation, the quick-release connector 15 and the control knob 29 make it a simple matter to move the clamp 5 up or down by means of the jack 3, so that the pieces are held at the most convenient height.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. A trolley comprising a platform mounted on wheels, a vertical jack comprising a member movable vertically upward and downward, said member having a free end and a clamp mounted at said free end, said clamp having two contra-acting branches, said clamp including maneuvering means linking said branches and for controlling relative movement of said branches towards and away from each other, at least one of said branches extending generally parallel to the plane of said platform, said maneuvering means including means for immobilizing said one branch in a selected one of a plurality of rotational positions, said clamp being supported through said one branch on said member, said maneuvering means including a ratchet mounted on said member resiliently urged into a first position, a disk mounted on one end of said one branch, said disk having a perimeter including a plurality of spaced notches for receiving said ratchet when in said first position, a shaft extending from said disk on one side thereof, said one branch being attached to said disk on the side thereof opposite said one side coaxially with said shaft, said disk including slide means, said other branch including an arm having a portion received in said slide means, said arm having a plurality of depressions spaced therealong on one side thereof, said disk having a small ratchet carried thereon and movable into and out of engagement with a said depression.

2. Trolley according to claim 1, wherein said branches are parallel to one another and extend over said platform.

3. Trolley according to claim 2, further comprising an arm which passes through said member and which is perpendicular to one of said branches and clamping means on said member adapted to immobilize said arm relative to said member, wherein one of said branches is attached to said member and the other of said branches is attached to one end of said arm.

4. The trolley according to claim 1 wherein said disk has a recess within which said small ratchet is disposed, said slide means of said disk comprises a diametral opening disposed vertically therethrough in which said arm is slidable and with which said recess communicates, said disk having another shaft passing therethrough and accessible externally thereof and on which said small ratchet is mounted.

5. Trolley according to claim 1, further comprising two vertical tubular columns between which said jack is disposed, two sliders disposed one on each of said columns and a member linking said sliders and carrying said clamp, said sliders.

6. A trolley comprising a platform mounted on wheels, a vertical jack comprising a member movable vertically upward and downward, said member having a free end and a clamp mounted at said free end, said clamp having two contra-acting branches, said clamp including maneuvering means linking said branches and for controlling relative movement of said branches towards and away from each other, said trolley including two vertical tubular columns between which said jack is disposed and two sliders each disposed on one of said columns with said member extending between and connecting said sliders, one of said columns being sealed and having at its upper end a quick release connector for connection to a compressed air supply, said jack being fluidly connected with said one column to pneumatically operated said jack.

7. Trolley according to claim 6, further comprising a distributor for directing and venting air to said jack, a control unit for said distributor and an air vent at the lower end of the other of said columns, a linkage in said other column and a control knob at the top of said other column coupled to said control unit by said linkage.

* * * * *